United States Patent [19]

Morioka

[11] Patent Number: 4,936,730

[45] Date of Patent: Jun. 26, 1990

[54] ELEVATED GARAGE

[75] Inventor: Hiroshi Morioka, Kanazawa, Japan

[73] Assignee: Nissei Build Kogyo Kabushiki Kaisha, Kanagawa, Japan

[21] Appl. No.: 363,376

[22] Filed: May 26, 1989

Related U.S. Application Data

[63] Continuation of Ser. No. 126,757, Nov. 30, 1987, abandoned.

[30] Foreign Application Priority Data

| | | | |
|---|---|---|---|
| Dec. 24, 1986 | [JP] | Japan | 61-314495 |
| May 15, 1987 | [JP] | Japan | 62-118568 |
| Sep. 26, 1987 | [JP] | Japan | 62-241680 |

[51] Int. Cl.[5] ..... E04H 6/22

[52] U.S. Cl. ..... 414/239; 414/264; 414/282

[58] Field of Search ..... 414/231, 233, 234, 282, 414/239–241, 253–256, 259–261, 264, 659–661

[56] References Cited

U.S. PATENT DOCUMENTS

| | | | |
|---|---|---|---|
| 1,605,220 | 11/1926 | Cuvillier et al. | 414/234 |
| 2,650,728 | 9/1953 | Goodwyn | 414/661 |
| 2,667,980 | 2/1954 | Dawson | 414/256 |
| 2,838,186 | 6/1958 | Alimanestiano | 414/254 |
| 2,890,802 | 6/1959 | Alimanestiano | 414/254 |
| 2,951,599 | 9/1960 | Bogar | 414/264 X |
| 3,190,467 | 6/1965 | English | 414/234 |
| 3,240,364 | 3/1966 | Kapnek et al. | 414/240 X |
| 3,249,260 | 9/1964 | Frangos . | |
| 3,710,956 | 1/1973 | Meyer . | |
| 3,737,057 | 6/1973 | Neumann et al. | 414/239 X |
| 4,312,623 | 1/1982 | Allred et al. | 414/231 X |
| 4,388,033 | 6/1983 | Pipes | 414/282 |

FOREIGN PATENT DOCUMENTS

| | | | |
|---|---|---|---|
| 253424 | 4/1963 | Australia | 414/254 |
| 1224425 | 7/1987 | Canada | 414/661 |
| 2131157 | 12/1971 | Fed. Rep. of Germany . | |
| 61-146973 | 7/1986 | Japan . | |
| 61-151374 | 7/1986 | Japan . | |
| 61-176769 | 8/1986 | Japan . | |
| 62-185972 | 4/1987 | Japan . | |
| 74100570 | 2/1985 | Taiwan . | |
| 989859 | 4/1965 | United Kingdom . | |
| 86/02687 | 5/1986 | World Int. Prop. O. | 414/256 |

*Primary Examiner*—David A. Bucci

*Attorney, Agent, or Firm*—Oblon, Spivak, McClelland, Maier & Neustadt

[57] ABSTRACT

An elevated garage which includes a vertical framework structure having an entrance, through which cars are introduced; a plurality of parking spaces for accommodating the cars, wherein the packing spaces are piled in vertical one or more rows; an elevator including a lift movable up and down in the framework structure, the lift being adapted to receive a pallet on which the car is placed; an expander provided on the lift, the expander being expandable toward the parking space; a shelf provided in each parking space in such a manner as to be free from the expander, the shelf being adapted to support the pallet; and a rotor for turning the car into an appropriate posture for riding on the pallet.

5 Claims, 12 Drawing Sheets

ELEVATED GARAGE

This application is a continuation of application Ser. No. 07/126,757, filed on Nov. 30, 1987, now abandoned.

BACKGROUND OF THE INVENTION

1. Field of the Invention

The present invention relates to an elevated garage adapted for being built in a limited space in cities. In this specification the term "elevated" means a state where parking places are piled in vertical one or more rows, including a state where they extend underground.

2. Description of the Prior Art

One of the modern urban problems is a parking problem, which involves two difficulties; one is the difficulty of parking cars in cities, and the other is traffic jams caused by parked cars in busy streets. Parking problems are becoming more serious because of the soaring prices of land. Recently land prices have become too expensive to construct garages in cities. There are many proposals for solving the parking problems, among which is an elevated garage. The most popular is a gondola type shaped like a Ferris wheel. This type of garage is provided with many gondolas for accommodating cars therein. The gondolas are carried on conveyor chains circulating through sprockets, and travel in a circle with cars accommodated thereon.

Under this system the conveyor chains are subjected to the entire weight of the loaded cars and gondolas per se. To withstand such a heavy load the conveyor chains must have sufficient strength. It often happens that the loading of cars is one-sided, thereby causing unequal balance. To support the heavy load, particularly the one-sided load, the motors must have a large capacity. Consequently the system as a whole necessarily becomes large scaled and expensive.

SUMMARY OF THE INVENTION

The present invention aims at solving the problems pointed out above, and has for its object providing an elevated garage adapted for being built in a limited space in cities.

Another object of the present invention is to provide an elevated garage which operates with relatively small power, thereby reducing the production and running costs.

Other objects and advantages of the present invention will become more apparent from the following detailed description, when taken in conjunction with the accompanying drawings which show, for the purpose of illustration only, one embodiment in accordance with the present invention.

According to the present invention there is provided an elevated garage which comprises a vertical framework structure having an entrance, through which cars are introduced; a plurality of parking spaces for accommodating the cars, wherein the parking spaces are piled in one or more columns; an elevator including a lift movable up and down in the framework structure, the lift being adapted to receive a pallet on which the car is placed; an expander provided on the lift, the expander being expandable toward the parking space; a shelf provided in each parking space in such a manner as to be free from the expander, the shelf being adapted to support the pallet; and a rotor for turning the car into an appropriate posture for riding on the pallet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
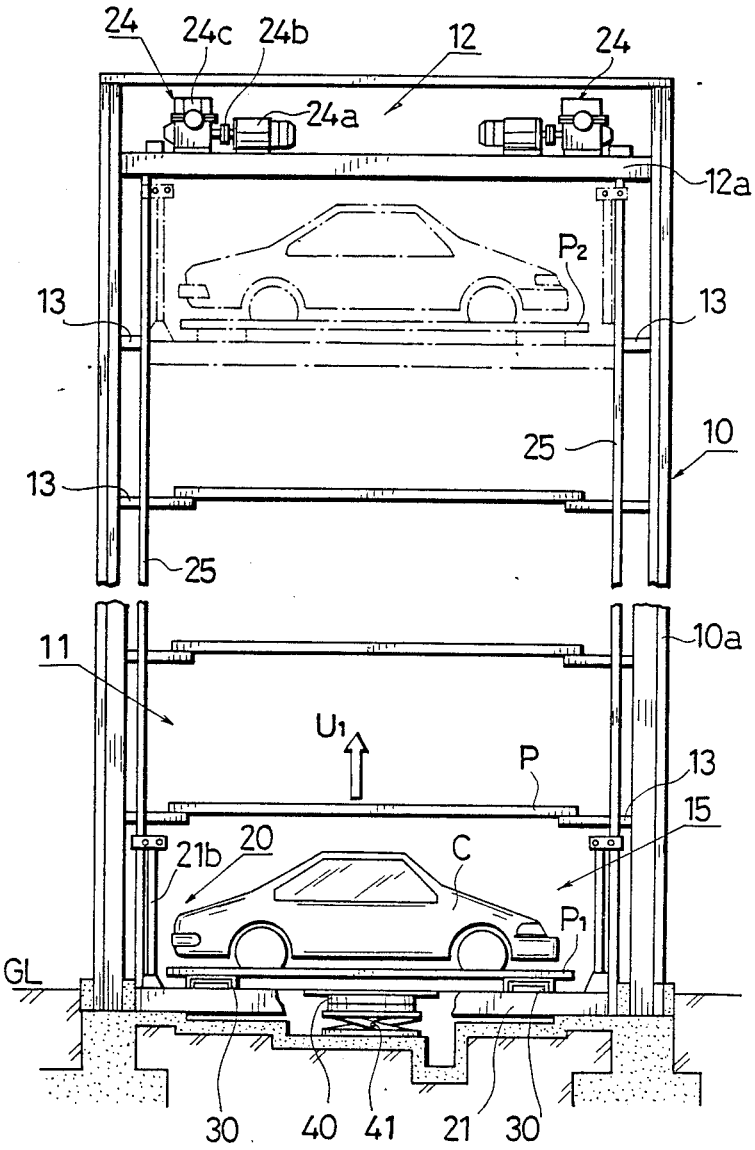
FIG. 1 is a front view showing an elevated garage embodying the present invention.
Figure 2:
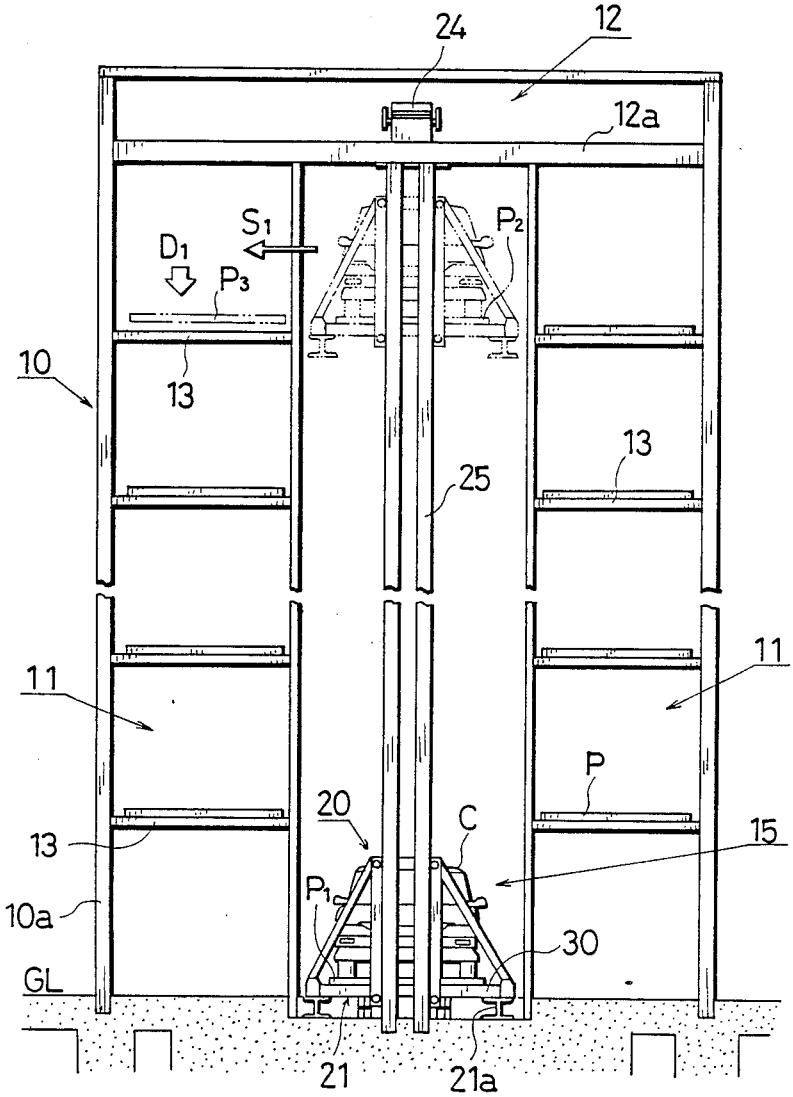
FIG. 2 is a right side view of the elevated garage of FIG. 1.

Referring to FIGS. 1 and 2 the elevated garage of the present invention includes a framework 10 for accommodating cars, an elevator 20, and expanders 30. The reference numeral 15 denotes a home position at which a car is loaded or unloaded. The framework 10 includes a pair of accommodating spaces 11 provided symmetrically with respect to guide posts 25 along which the elevator 20 ascends and descends with cars accommodated in the spaces 11.

The framework 10 is supported by columns 10*a*, including a machine room 12 on its top floor. The spaces 11 are provided on each floor. The columns 10*a* are individually provided with shelves 13 projecting inward on which a pallet (P) is placed. Cars are passed into the space 11 by the pallet.

The machine room 12 includes a base frame 12*a* on which a pair of driving devices 24 are provided for driving the elevator 20. Each driving device 24 includes a motor 24*a*, a coupling 24*b* and a speed reducer 24*c*, which will be described in detail with reference to FIG. 3.

There is provided a lift 21 driven by the driving device 24 at each side of the guide posts 25, the lift 21 including stands 21*b*. The lift 21 and stands 21*b* ascend and descend together. Each of the lift 21 is provided with the expanders 30 in pairs whereby the pallet (P) is horizontally shifted, which will be described in detail with reference to FIGS. 5 to 7.

The guide posts 25 are fixed to the base frame 12*a* at their top ends. The home position 15 is a starting position and a final position where a car is loaded on or unloaded from the garage, which will be described in detail with reference to FIGS. 8 to 15:

To load a car (C) on the garage the following procedure is taken:

The pallets (P) are placed on the shelves 13 in all the spaces 11 except one space, and a car (C) is loaded on the pallet ($P_1$) on the lift 21 which is located at the home position 15. The lifts 21 are driven to ascend up to a space 11 having no pallet (P) (in the direction of the arrow $U_1$ in FIG. 1). The lift 21 is stopped at a level where the undersurface of the pallet ($P_2$) on the expanders 30 takes a higher position above the shelves 13. Then the expanders 30 are expanded into the respective spaces 11 (in the direction of arrow ($S_1$) in FIG. 2), and simultaneously the lift 21 is slightly descended, thereby supporting the pallet ($P_3$) loaded with the car on the shelves 13. The procedure for loading a car on the garage finishes with the withdrawal of the expanders 30.

To load a next car on the garage the pallet (P) is transferred from the spaces 11 to the home position 15, and shifted from the shelves 13 onto the expanders 30. Then the lift 21 is driven to descend to its lowest position so that the car is ready to load on the garage at the home position 15. Thereafter the same procedure as described above is taken. In this way all the spaces 11 are loaded with cars one by one. The lift 21 is left stationary until the next loading or unloading starts.

To unload a car from the garage the lift 21 is driven to move to the spaces 11 in which the designated car is accommodated, and stopped at a level where the top surfaces of the expanders 30 are lower than the undersurfaces of the car-loaded pallet (P). The expanders 30 are expanded into the space 11 accommodating the designated car, and the lift 21 is driven to rise to transfer the car-loaded pallet from the shelves 13 to the expanders 30, which are then contracted to place the car at the center of the lift 21. Then the lift 21 is driven to descend to its lowest position so that the car is ready to unload from the garage. If continuously a next car is to be unloaded from another space 11 the pallet is withdrawn from the lift 21, and thereafter the same procedure is repeated. If continuously a car is to be loaded on the garage the car is placed on the pallet placed on the lift 21, and the above-mentioned car-loading procedure follows.

Figure 3:
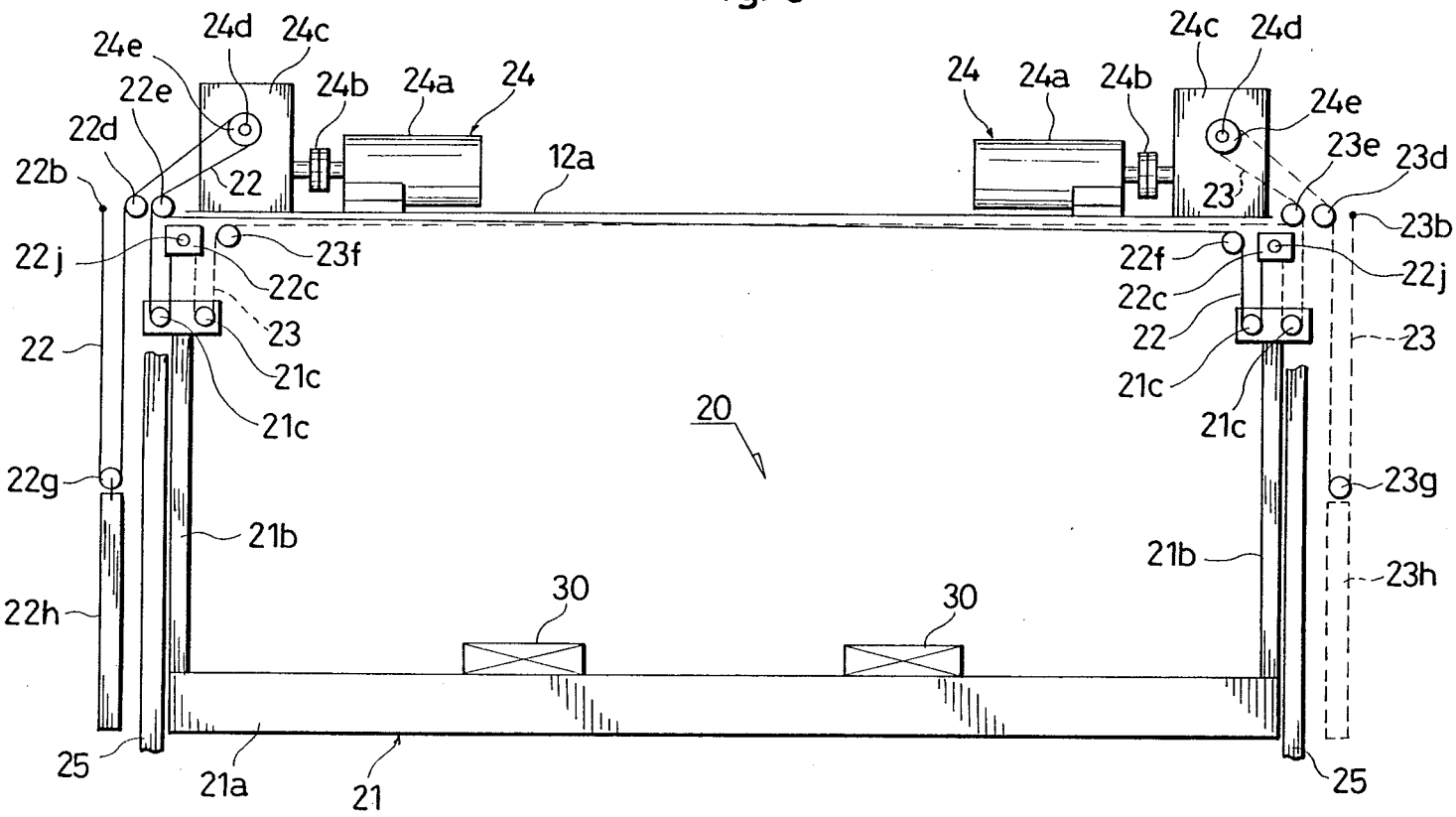
FIG. 3 is a front view showing the elevator used in the elevated garage of FIG. 1.

Referring to FIG. 3 the elevator 20 will be described in detail:

As referred to above the elevator 20 is a unitary body, which comprises the pair of driving devices 24, the lift 21, chains 22, 23 for hanging the lift 21, and the guide posts 25. The speed reducers 24*c* are provided with two output shafts 24*d* at opposite sides, to which sprockets 24*e* are fixed.

The lift 21 comprises lower frames 21*a* having the pair of expanders 30, and stands 21*b* upright on the lower frames 21*a*. The stands 21*b* are provided with sprockets 21*c*, and rollers (not shown) for pinching the guide posts 25 at two points so as to prevent the lift 21 from fluctuating while it moves up and down along the guide posts 25.

The chain 22 consists of two chain members, running on the left-hand sprockets 24*e* (the left-hand chains members 22 are indicated by substantial lines). Likewise the chain 23 consists of two chain members, running on the sprockets 24*e* (the chain members 23 are indicated by phantom lines).

Now, reference will be made to the left-hand driving mechanism with reference to FIG. 3:

Each chain member 22 starts from a fixed joint 22*b* and reaches a sprocket 22*e* via sprockets 22*g* and 22*d*. The reference numeral 22*h* denotes a weight suspended from the sprocket 22*g*. The fixed point 22*b*, and the sprockets 22*g*, 22*d*, 22*e* are provided for each chain member 22. The weight 22*h* is used in common with the two sprockets 22*g*. One of the two chain members 22 reaches a first tension adjuster 22*c* from the sprocket 22*e*, and the other transversely extends to reach a second tension adjuster 22*c* on the right-hand side.

Likewise, each chain member 23 starts from a fixed joint 23*b*, and reaches a sprocket 23*e* via sprockets 23*g* and 23*d*. From the sprocket 23*e* one chain member 23 transversely extends to reach a second tension adjuster 22*c* and the other reaches a first tension adjuster 22*c* on the left-hand side.

In this way the lift 21 is hung by the four chain members 22 and 23, and driven by the pair of driving devices 24. The drive is equally imparted to the stands 21*b* of the lift 21. The tension adjusters 22*c* are fixed by pins 22*j* in such a manner as to be adjustable in position with respect to the frame 12*a*, thereby electrically controlling the tension of the chain members 22, 23 through the operation of a limit switch (not shown) so as to maintain a constant tension. The two driving devices 24 are synchronously driven.

Figure 4:
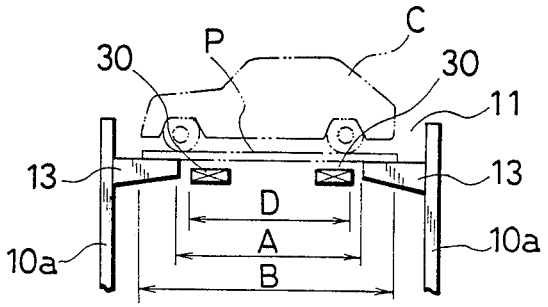
FIG. 4 is a diagrammatic view showing the dimensional relationship between the length of the pallet and the width of the expanders.

The expanders 30, as their names imply, are expandable in a direction perpendicular to the moving direction of the lift 21, which means that they are expandable toward the respective spaces 11. They can accommodate the car-loaded pallet (P). As shown in FIG. 4 the expanders 30 are provided in such a manner that they are free from the shelves 13 in the spaces 11 while the lift 21 moves with the expanders 30 expanded into the respective spaces 11. To this end the interval (A) between the top ends of the two shelves 13 is shorter than the length (B) of the pallet but is longer than the maximum width (D) covering the two expanders 30.

Figure 5:
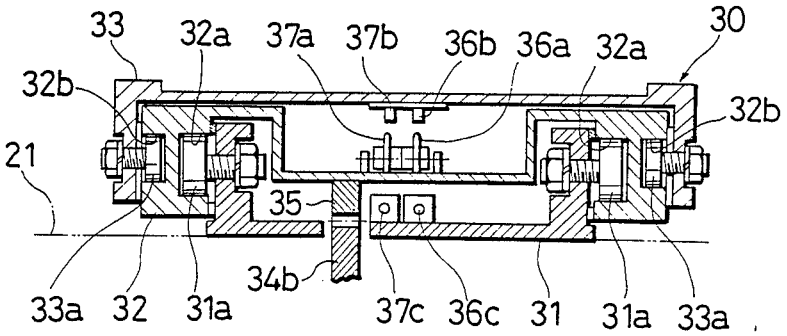
FIG. 5 is a cross-sectional view showing the expanders.
Figure 6:
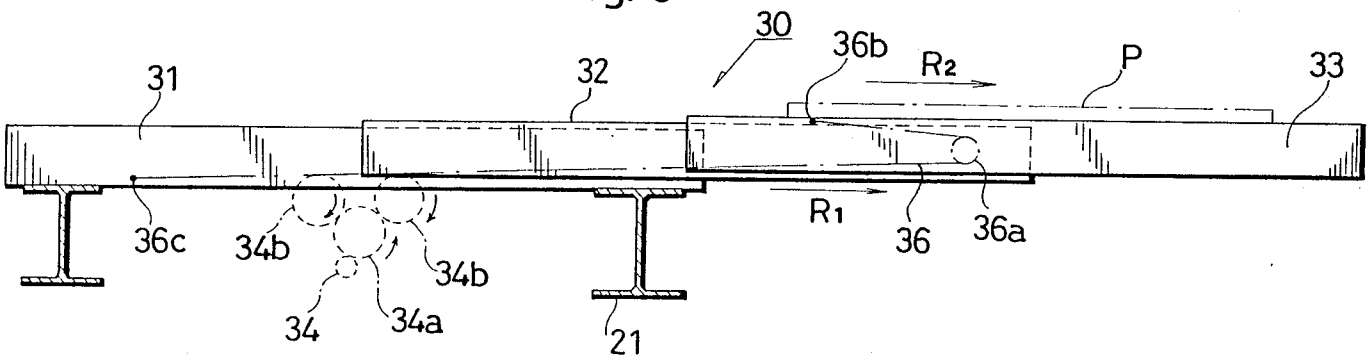
FIG. 6 is a side view showing the expanders in their expanded state.
Figure 7:
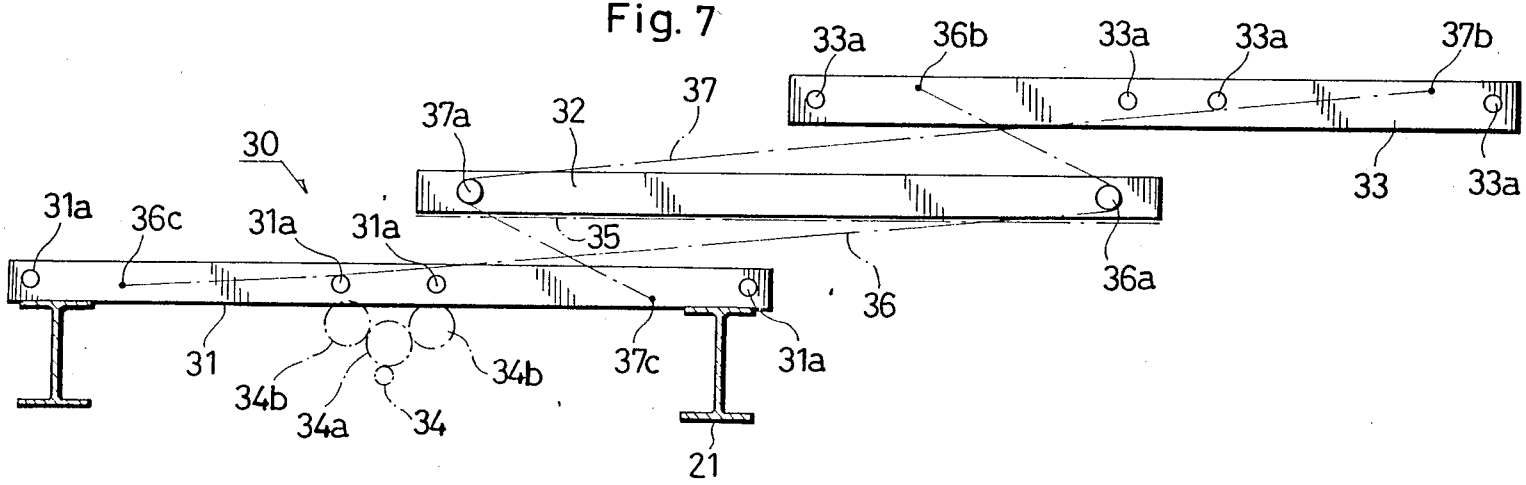
FIG. 7 is a side view showing the structure of the expanders.

Referring to FIGS. 5 to 7 the structure of the expander 30 will be more particularly described:

Each expander 30 includes a first member 31, a second member 32 and a third member 33, each of which, as shown in FIG. 5, is axially slotted in its center. The first member 31 is fixed to the lift 21. The second member 32 is provided with inside slots 32*a* and outside slots 32*b* in opposite side walls, respectively. The first member 31 is provided with two rollers 31*a* at each side (for a total of four rollers), and the third member 33 is provided with two rollers 33*a* at each side (totally four rollers). These rollers 31*a* and 33*a* are rotatively accommodated in the slots 32*a* and 32*b*, respectively, thereby effecting the unity of the three members 31, 32 and 33. The second member 32 is provided with sprockets 36*a* and 37*a* at each side, through which two chains 36 and 37 are connected to joints 36*c*, 37*c* and 36*b*, 37*b*. The two chains cross each other.

The first member 31 is provided with gears 34, 34a and 34b, which are driven by a motor (not shown). The gears 34b are engaged with toothed racks fixed to the undersurface of the second member 32. When the gear 34 is driven the second member 32 moves in the direction of arrow $R_1$, thereby stretching either of the chains 36 or 37 (in FIGS. 6 and 7 the chain 36 is stretched), and slackening the other. This enables the third member 33 to advance in the direction of $R_2$. In this way the whole expander 30 is expanded. When the gear 34 is reversely rotated the expander 30 contracts, and if the reverse rotation continues it expands in the opposite direction. The gear 34 is provided in a single piece, and works on the two expanders 30 by a single motor.

Figure 8:
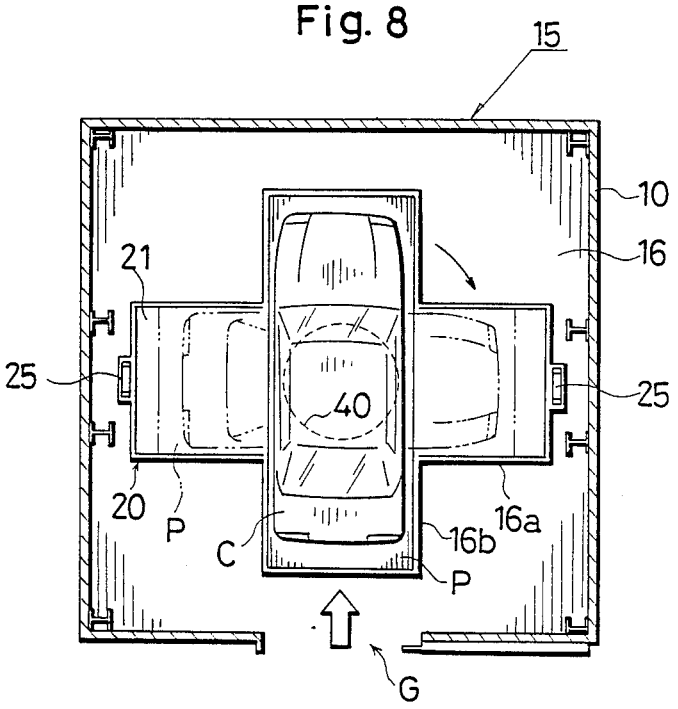
FIG. 8 is a diagrammatic plan view showing the home position.
Figure 11A:
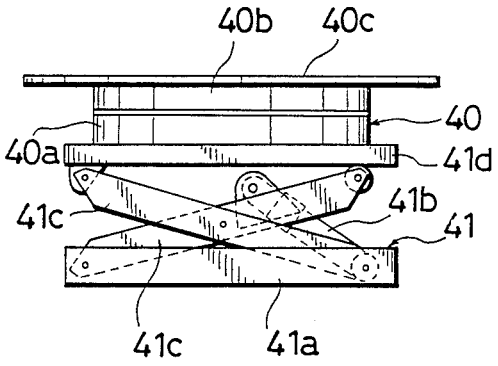
FIGS. 11(*a*), 11(*b*) are side views showing the rotor used in the elevated garage of FIG. 1.
Figure 11B:
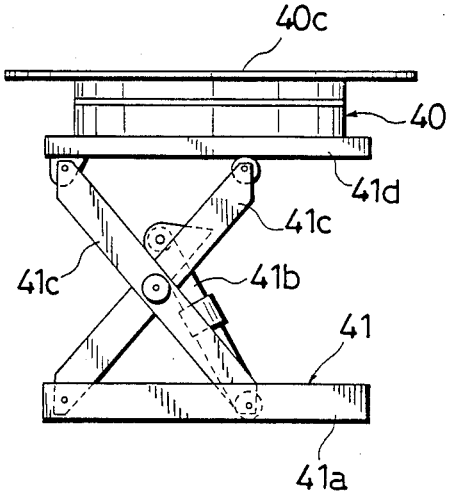

As shown in FIG. 8 there is provided a rotor 40 at the home position 15, whereby a car (C) is loaded onto or unloaded from the lift 21. The rotor 40 is supported by a lifter 41 as shown in FIGS. 11(*a*), 11(*b*). The lifter 41 includes a base 41a, expandable legs 41c driven by pneumatic cylinders 41b and a table 41d on which the rotor 40 is placed. The rotor 40 includes a fixed frame 40a and a rotary frame 40b to which a rotary base 40c is fixed. The rotary frame 40b is rotated by a motor through gearing (not shown).

As best shown in FIG. 8 the framework 10 is provided with an entrance (G) through which cars are loaded on or unloaded from the garage. The ground floor 16 includes a first pit 16a in which the lift 21 is housed, and a second pit 16b in which a pallet is housed. The two pits 16a and 16b cross each other. The pallet (P) descended by the lift 21 to the home position 15 is transferred onto the rotary base 40c by raising the lifter 41, and after being rotated at 90° it is housed in the pit 16b, thereby allowing a car (C) to load on the pallet (P). Then the car-loaded pallet (P) is rotated at 90° by the rotor 40 until it is in parallel with the lift 21. The lift 21 is driven to ascend so that the car-loaded pallet (P) is mounted thereon. The lift 21 is ascended to a floor having a vacant space 11.

Figure 9:
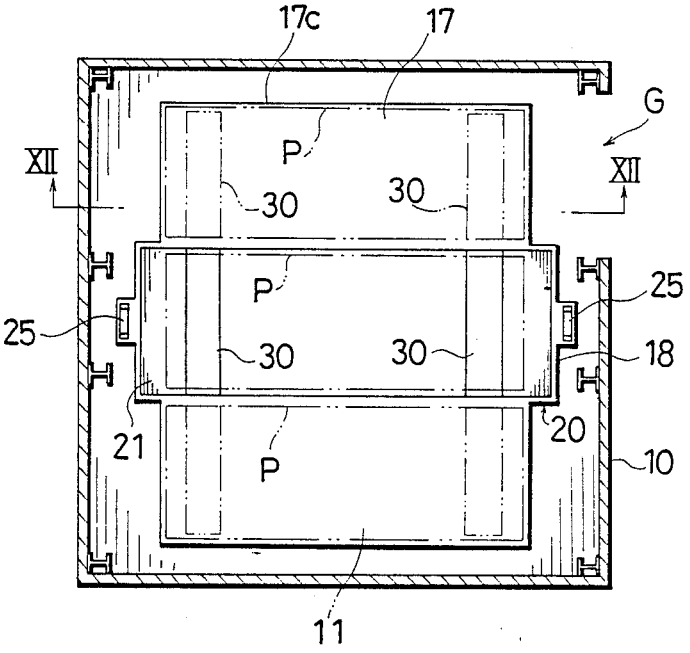
FIG. 9 is a diagrammatic plan view showing another example of the home position.

The home position 15 shown in FIG. 9 has no rotor 40, where an opening 18 is provided immediately below the lift 21 to accommodate the same. The entrance (G) is located toward a shorter side of a car mounting position 17.

Figure 12:
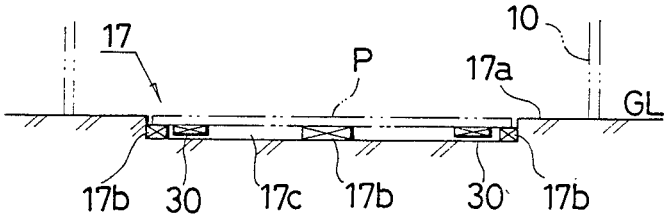
FIG. 12 is a cross-section taken along the line XII—XII in FIG. 9.

The car mounting position 17 comprises a floor 17a in which a pit 17c is provided to accommodate a pallet. The pit 17c is provided with brackets 17b for receiving the pallet (FIG. 12). It is possible to provide a turntable (not shown) outside the entrance (G). To load a car on the garage the pallet is placed on the expanders 30, and the lift 21 is driven to descend. The expanders 30 are expanded toward the car mounting position 17, and the lift 21 is descended to its lowest position until the pallet rests on the brackets 17b in the pit 17c. The car (C) is caused to advance with its front end forward through the entrance (G) until it parks on the pallet (P). Then the lift 21 is slightly ascended so that the car-loaded pallet (P) is transferred onto the expanders 30. At this stage the lift 21 is stopped, and the expanders 30 are caused to contract until the car is located at a central position in the lift 21. Thereafter the same procedure as that described above is taken. There is an accommodating space 11 on the ground floor, opposite to the car mounting position 17. When a car is to be accommodated in this space 11 it is first placed on the expanders 30, which are then expanded in an opposite direction. The lift 21 is driven to descend, leaving the car in the space 11.

To unload a car from the space 11 the first thing is to transfer the car from the space 11 to the center of the lift 21, which is then descended until the undersurfaces of the expanders 30 are slightly above the floor 17a. The expanders 30 are expanded toward the car mounting position 17, and the lift 21 is descended until the pallet rests on the brackets 17b in the pit 17c. The car is started backward, and goes out of the garage. If a turntable is used outside the garage the car can be turned in a desired direction.

Figure 10:
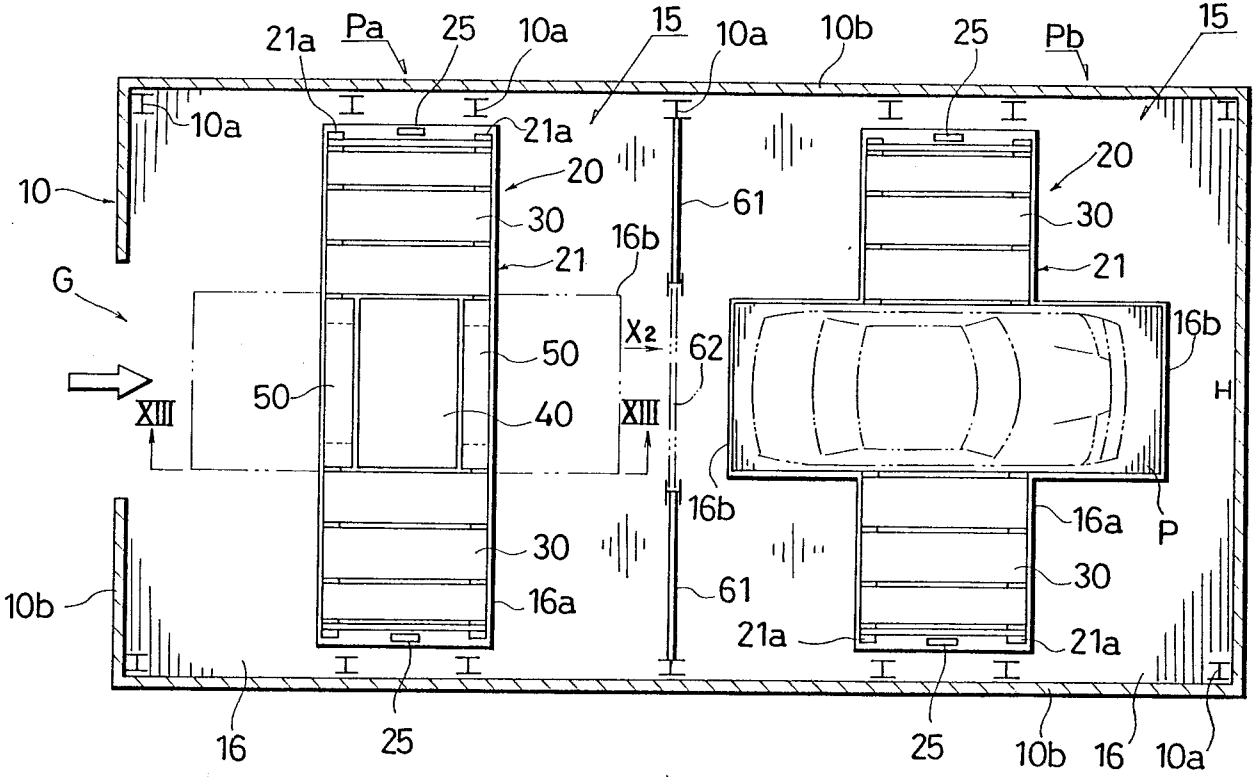
FIG. 10 is a diagrammatic plan view showing a further example of the home position.

FIG. 10 shows an example in which two frameworks 10 are arranged side by side to provide two compartments. Two elevators 20 are provided so that cars can be loaded on either of the garages through a single entrance (G).

A floor 16 is provided on a ground level (GL), in common with a first garage (Pa) and a second garage (Pb). The first garage (Pa) is provided with an entrance (G) in the framework 10, and each garage is provided with a first pit 16a in which the lift 21 is housed, and a second pit 16b in which a pallet is housed. The two pits 16a and 16b cross each other. Each pit 16a accommodates a rotor 40 capable of ascending and descending by a lifter 41.

The lift 21 can descend until its lower frames 21a find themselves in the pit 16a with the rotor 40 interlocated therebetween. At this stage the pallet placed on the lift 21 is raised by the rotary base 40c. In this way the pallet is caused to rotate.

Figure 13:
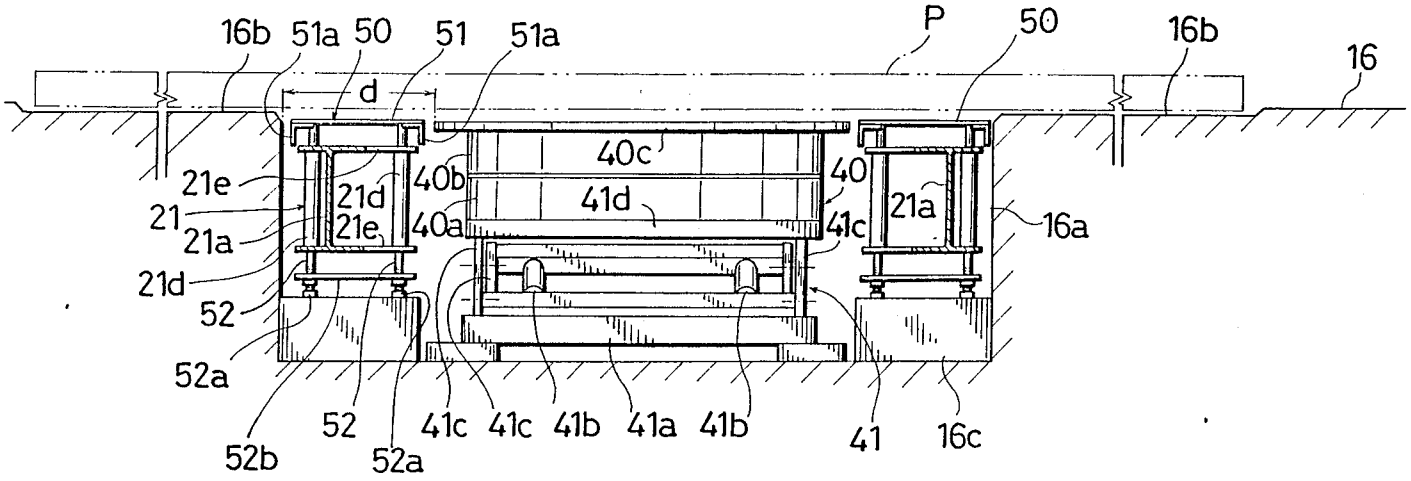
FIG. 13 is a cross-section taken along the line XIII—XIII in FIG. 9.
Figure 14:
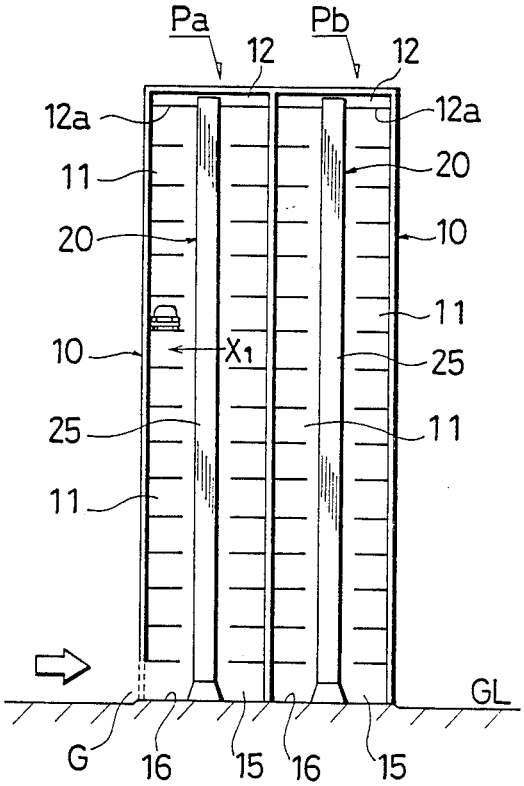
FIG. 14 is a front view showing an example of the applications of the present invention.
Figure 15:
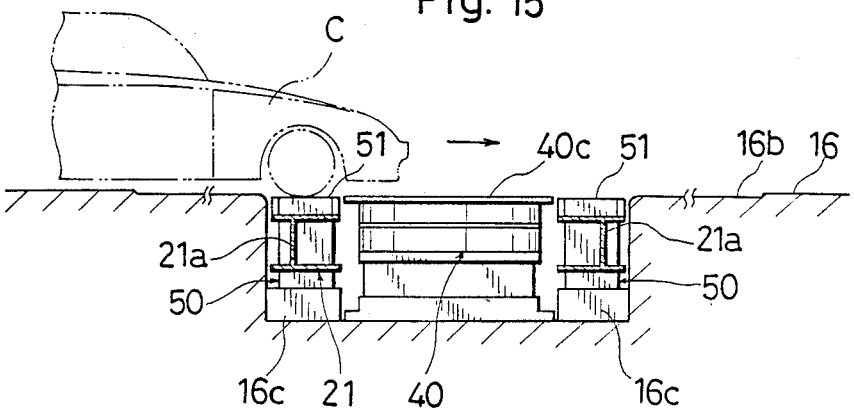
FIG. 15 is a diagrammatic view showing a state where a car passes over the pit.

As shown in FIG. 13 the lift 21 is provided with passageways 50 adapted to facilitate the passing of a car over the pit 16a. The passageway 50 includes a table 51 which is supported by four legs 52 having adjustable screws 52a whereby the length thereof is adjusted. The legs 52 are freely passed through pipes 21d fixed to the lower frame 21a of the lift 21 so that the passageways 50 are movable up and down with respect to the lift 21. In FIG. 13 the reference numeral 21e denotes spacers. The four legs 52 are united by a connecting plate 52b. The tables 50 are reinforced by steel bars 51a.

Each table 51 has a length equal to that of the pallet, and a width sufficient to cover a gap (d) between the rotary base 40c and the rim of the pit 16a (FIG. 13). Each legs 52 has a height sufficient to enable the table 51 to provide a flat surface together with the rotary base 40c over the pit 16a. It is arranged that no weight of the car applies to the lift 21 through the tables 51. The reference numeral 16c denotes stands whereby the legs 52 can be short. Before the lift 21 is driven to ascend, the passageways 50 are allowed to descend by gravity until the tables 51 come into engagement with the lower frame 21a. In this way the passageways 50 follow the ascending lift 21, and come out of the pit 16a.

As shown in FIG. 10 the compartments of the two garages are closed toward each other by a foldable metal curtain 62 in the center, and unfoldable metal partitions 61 at both sides thereof (FIG. 10).

This modified garage is operated as follows:

Now, suppose that there is a car (C) to be accommodated in the space 11 of the first garage (Pa). The pallets are placed on the shelves 13 in all the spaces 11 except for the one in which the car (C) is to be accommodated. The lift 21 is caused to descend and is housed in the pit 16a. One pallet is placed in the pit 16a in such a manner as to cross the lift 21.

The car (C) is driven into the garage (Pa) through the entrance (G) with its front end forward, and rides on the pallet at the home position 15 of the garage (Pa).

Preferably the pallet is provided with tire guiding grooves and a car positioning recess. After the car (C) rides on the pallet (P) the driver leaves the car and goes out of the garage (Pa).

Then the lifter 41 is driven to ascend so that the bottom of the car-loaded pallet (P) is raised by the rotor 40, thereby allowing the pallet (P) to rotate until it extends parallel to the lift 21.

Subsequently the lift 21 is driven to ascend so as to raise the car-loaded pallet (P) to the designated space 11, and the car (C) is shifted from the pallet (P) into the space 11.

To park a car in the garage (Pb) the same procedure is basically taken but with the following differences:

The car (C) must pass through the first garage (Pa). To this end the passageways 50 are used to enable the car to pass over the pit 16*a*. First, the lift 21 of the garage (Pa) is driven to descend to its lowest position, followed by the descent of the passageways 50. When the passageways 50 are housed in the pit 16*a* their tables 51 provide a flat surface for the car to pass on. The foldable metal curtain 62 is appropriately folded or unfolded.

Instead of using the passageways 50 a pallet can be employed as a bridge for the car to pass over the pit 16*a*. In FIG. 13 this substitute bridge is indicated by phantom lines. The pallet (P) is placed in the shallow pit 16*b*.

The same procedure is used when three or more garages are connected in series.

Figure 16:
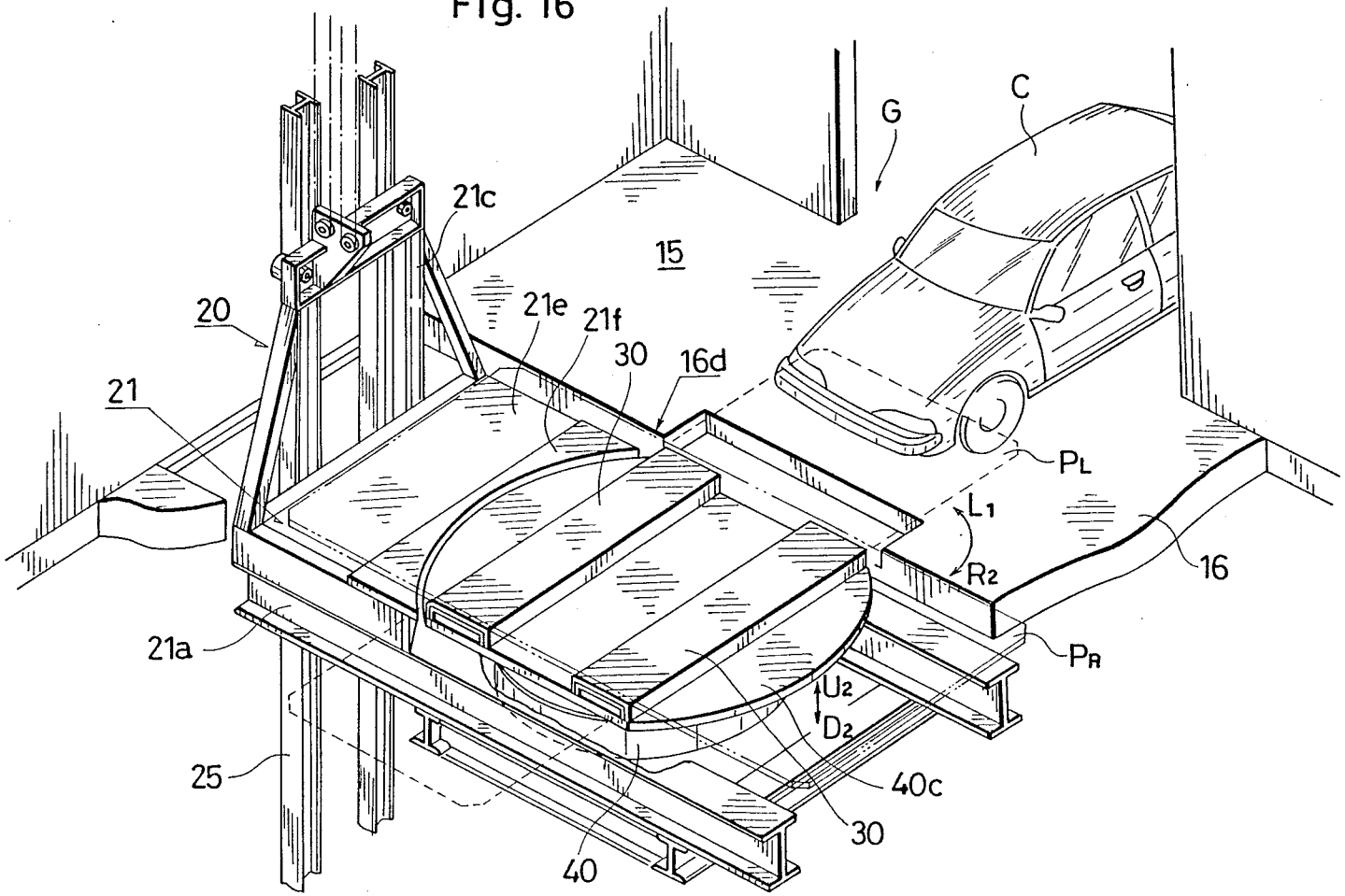
FIG. 16 is a perspective view showing another example of the applications.
Figure 17:
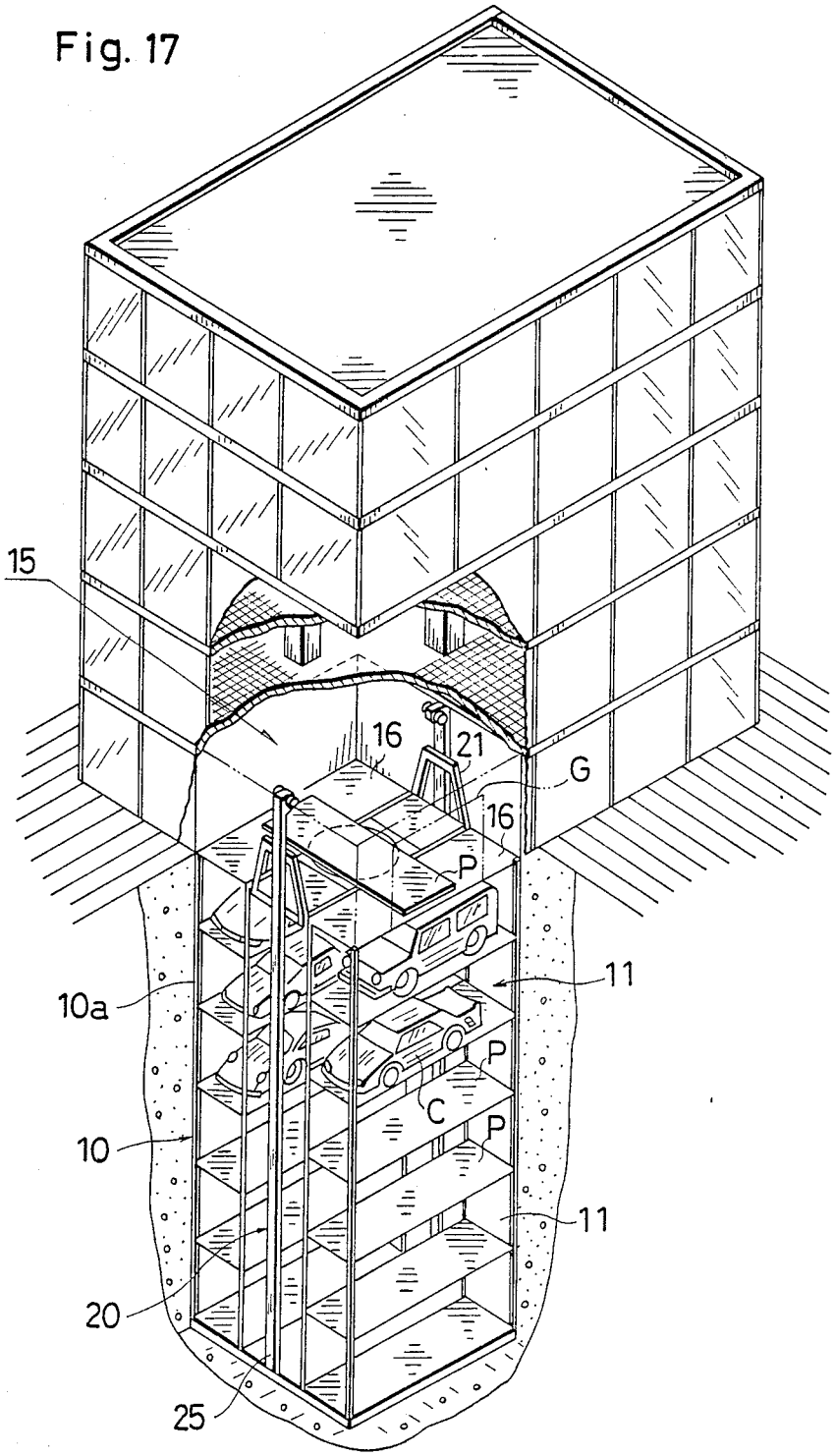
FIG. 17 is a perspective view showing a further example of the applications.

Referring to FIGS. 16 and 17, examples of the applications will be described:

FIG. 16 shows an example in which the home position 15 is provided on other floor than the first floor (or ground floor), and FIG. 17 shows an example in which most of the parking spaces 11 are provided underground.

In the example of FIG. 16 the ground floor 16 is provided with an excavation 16*d*, and the lift 21 is provided with a rotor 40 at its center. The rotor 40 includes a rotary base 40*c* on which the expanders 30 are provided in such a manner that the top surfaces thereof are higher than a fixed deck 21*e* and an auxiliary deck 21*f*. The rotor 40 houses a set of gears and a motor, through which the rotary base 40*c* is rotated in either direction of arrow $L_1$ or $R_2$.

To load a car on the garage a pallet is placed on the lift 21, which is shifted to the home position 15. The lift 21 is stopped at a level where the bottom of the pallet ($P_R$) is higher than the ground floor 16. At this position the pallet is rotated at 90° by the rotary base 40*c*, and takes the posture indicated by dotted lines ($P_L$). At this stage the lift 21 is driven to descend until the pallet ($P_L$) provides a flat surface for the car (C) to pass on easily. The car (C) is caused to ride on the pallet ($P_L$). Since the excavation 16*d* is covered with the pallet ($P_L$) and the lift 21, no danger exists for the operator and the driver walking in the garage.

Subsequently the lift 21 is driven to ascend until the car-loaded pallet is supported by the expanders at its bottom in such a manner that the longer side of the pallet is perpendicular to the expanding direction of the expanders 30. Again, the pallet ($P_L$) is rotated 90° until it extends parallel to the lift 21. In this way the car-loaded pallet is accommodated in the designated space 11.

To unload a car from the space 11 the reverse procedure occurs. When the rotor 40 is rotated 90° by 90° in the same direction the car can be taken out of the garage with its front end forward.

The example illustrated in FIG. 17 is particularly advantageous when the garages are built at busy streets in cities where spare land is very rare and expensive.

According to the present invention cars are conveyed one by one to designated floors, thereby eliminating the necessity of employing a large-scale elevator and a large-capacity motor. The elevator is independent of the framework structure unlike a gondola type garage. If the framework structure is modified to increase its parking capacity it is not necessary to increase the capacity of the elevator but only to lengthen the stroke thereof. This makes it easy to increase the parking area in the garage.

The garage of the present invention can be connected in series or built underground, thereby contributing to a solution to the parking problem in cities.

Obviously, numerous modifications and variations of the present invention are possible in light of the above teachings. It is therefore to be understood that within the scope of the appended claims, the invention may be practiced otherwise than as specifically described herein.

What is claimed is:

1. An elevated garage, which comprises:

a vertical framework structure having an entrance, through which cars are introduced and having a home position provided at the same height as said entrance;

a plurality of parking spaces for accommodating the cars on a pallet, wherein the parking spaces are positioned in one or more columns in the framework structure;

an elevator including lift movable up and down in the framework structure, the lift being adapted to receive and to take out said pallet on which the car is placed between said home position and said parking spaces;

an expander provided on the lift, the expander being expandable toward the parking space substantially horizontally for delivering a pallet;

a shelf provided in each parking space in such a manner as to be free from the expander, the shelf being adapted to support a front and rear portion of said pallet; and a rotor for turning the car into an appropriate posture for riding on said pallet wherein said rotor is located immediately below the elevator at said home position, and including a lifter for lifting up and down the rotor.

2. An elevated garage as defined in claim 1, wherein the elevator includes two driving devices which are driven synchronously and a pair of chain trains connecting the lift to the driving devices, and wherein the lift is movable up and down along a pair of guide posts upright in the framework structure.

3. An elevated garage as defined in claim 1, wherein the expander comprises a first member, a second member and a third member, the first member being fixed to the lift, the second member being independently expandable by a driving means engaged therewith, and the third member being connected to the first and second members by means of chains which are connected to said members.

4. An elevated garage as defined in claim 1, wherein a plurality of framework structures are connected to each other and each garage includes an elevator and a rotor, and a passageway covering a pit wherein said rotor is provided so that the car passes over the pit.

5. An elevated garage as defined in claim 4, wherein the rotor has a rotary base and the lift has a plurality of tables, each of said tables having a flat top surface and a plurality of legs which are slidable through a frame portion of said lift, wherein the top surfaces of the table and the rotary base form the passageway where the legs move into abutment with the bottom of the pit such that the car applies no weight directly to the frame of said lift.

* * * * *